US008286697B2

(12) United States Patent
Evans et al.

(10) Patent No.: US 8,286,697 B2
(45) Date of Patent: Oct. 16, 2012

(54) INTERNALLY SUPPORTED PERFORATING GUN BODY FOR HIGH PRESSURE OPERATIONS

(75) Inventors: Randy L. Evans, Sugar Land, TX (US); Avigdor Hetz, Houston, TX (US); Mark Sloan, Magnolia, TX (US); William D. Myers, Spring, TX (US); Nauman H. A. L. Mhaskar, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 172 days.

(21) Appl. No.: 12/773,664

(22) Filed: May 4, 2010

(65) Prior Publication Data

US 2010/0276136 A1 Nov. 4, 2010

Related U.S. Application Data

(60) Provisional application No. 61/175,361, filed on May 4, 2009.

(51) Int. Cl.
*E21B 43/117* (2006.01)

(52) U.S. Cl. ..... 166/55.2

(58) Field of Classification Search ..... 166/55, 166/55.1, 55.2, 297; 102/307, 321
See application file for complete search history.

(56) References Cited

U.S. PATENT DOCUMENTS

| | | | | |
|---|---|---|---|---|
| 2,649,046 | A * | 8/1953 | Davis | 102/310 |
| 3,773,119 | A * | 11/1973 | Shore | 175/4.6 |
| 4,191,265 | A * | 3/1980 | Bosse-Platiere | 175/4.56 |
| 4,598,775 | A * | 7/1986 | Vann et al. | 175/4.6 |
| 5,598,891 | A * | 2/1997 | Snider et al. | 166/308.1 |
| 5,837,925 | A * | 11/1998 | Nice | 102/310 |
| 6,158,511 | A * | 12/2000 | Wesson | 166/308.1 |
| 6,520,258 | B1 | 2/2003 | Yang et al. | |
| 6,655,291 | B2 | 12/2003 | Pratt et al. | |
| 6,732,798 | B2 * | 5/2004 | Johnson et al. | 166/297 |
| 7,055,421 | B2 * | 6/2006 | Kash | 89/1.15 |
| 7,828,051 | B2 * | 11/2010 | Walker | 166/55.1 |
| 2006/0201371 | A1 | 9/2006 | Li et al. | |

FOREIGN PATENT DOCUMENTS

WO 9814689 2/1998

OTHER PUBLICATIONS

International Search Report and Written Opinion for PCT/US 2010/033897, dated Nov. 22, 2010, 11 pages.

* cited by examiner

*Primary Examiner* — Daniel P Stephenson
(74) *Attorney, Agent, or Firm* — Bracewell & Giuliani LLP

(57) ABSTRACT

A perforating system having a perforating gun with a high pressure gun body. The gun body can be thickened so that no empty space is present between it and a corresponding gun tube. Alternatively, the gun body could be a solid cylinder with slots radially formed therein to receive a shaped charge. In another embodiment, a flowable material, such as foam, fluid, sand, ceramic beads, eutectic metal, and combinations thereof, is provided in the space between the gun body and gun tube.

13 Claims, 4 Drawing Sheets

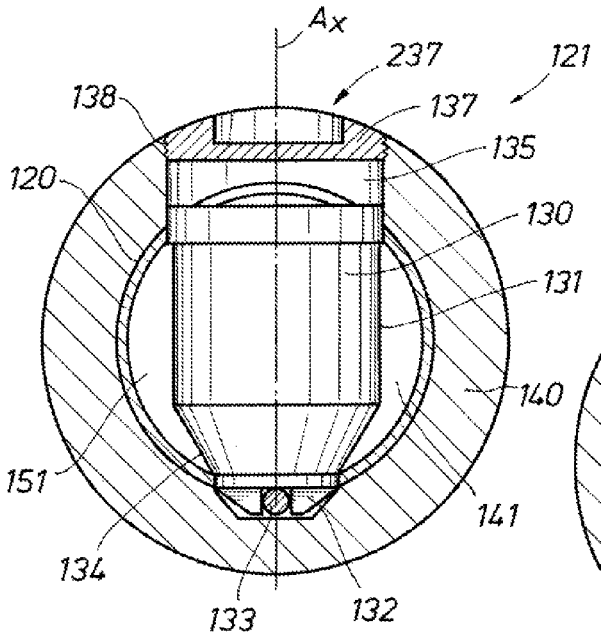
FIG. 3
FIG. 3A
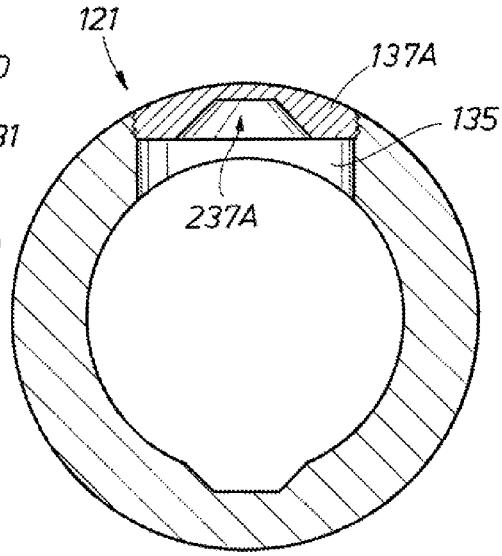
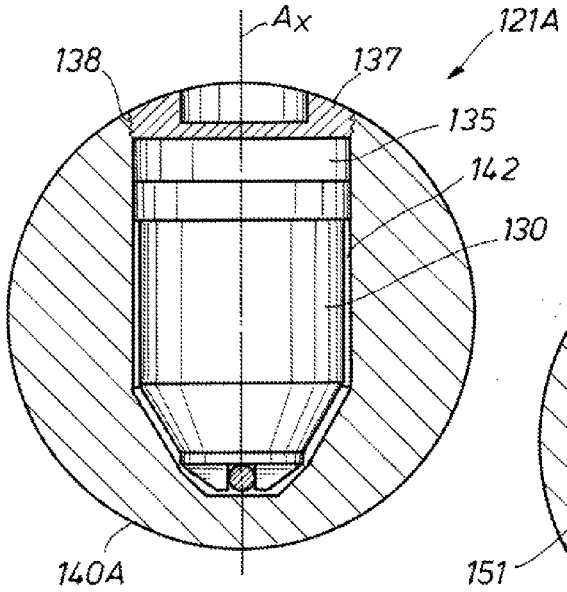
FIG. 4
FIG. 5
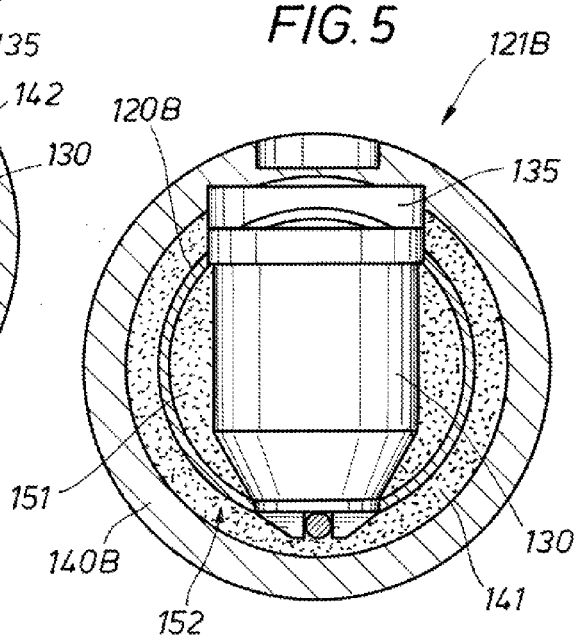

FIG. 5A
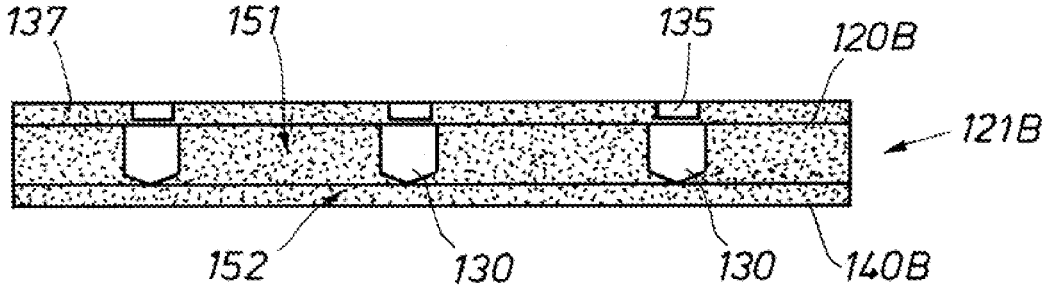
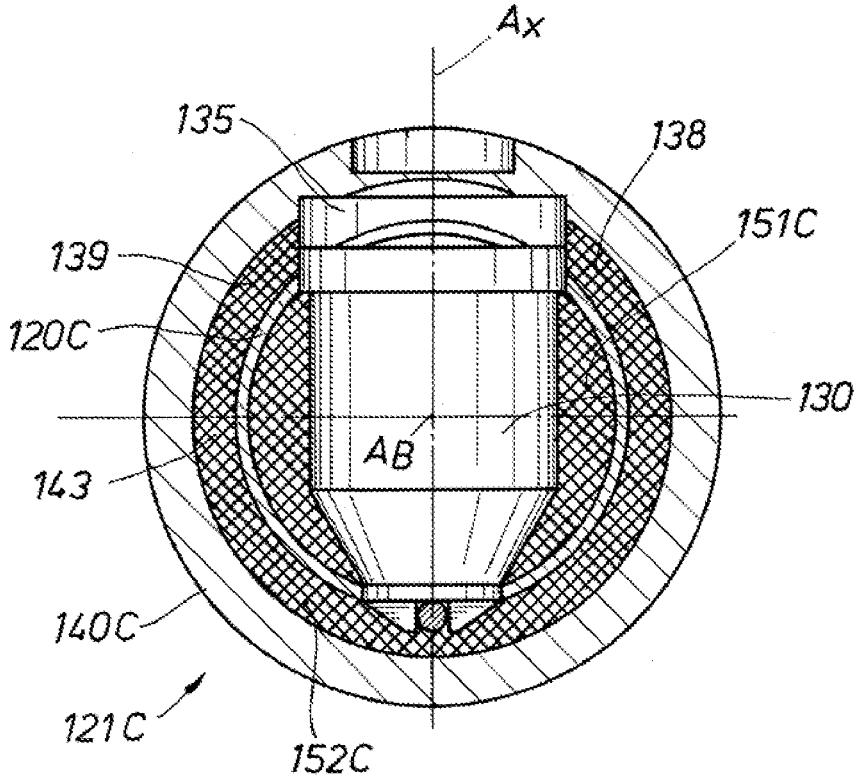
FIG. 6
FIG. 6A
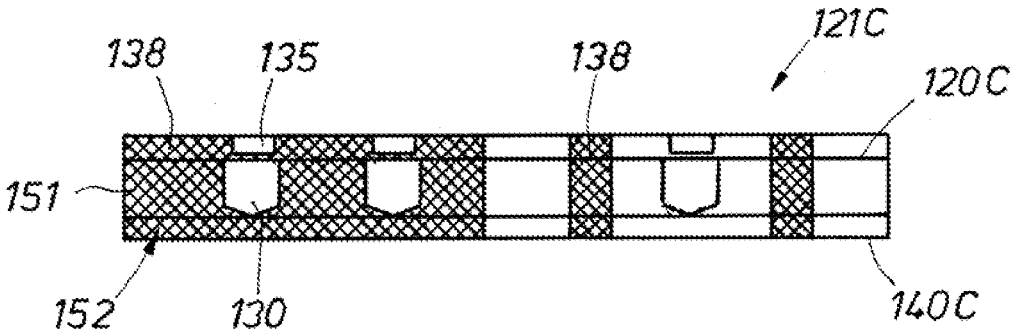

FIG. 7
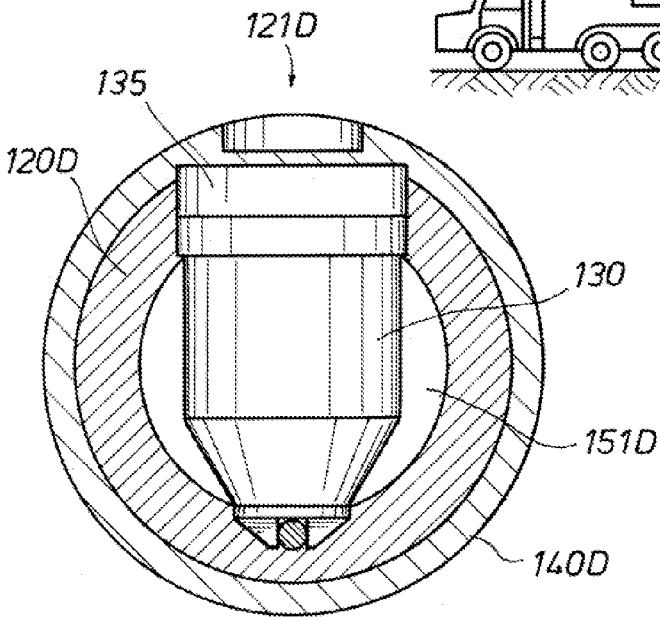
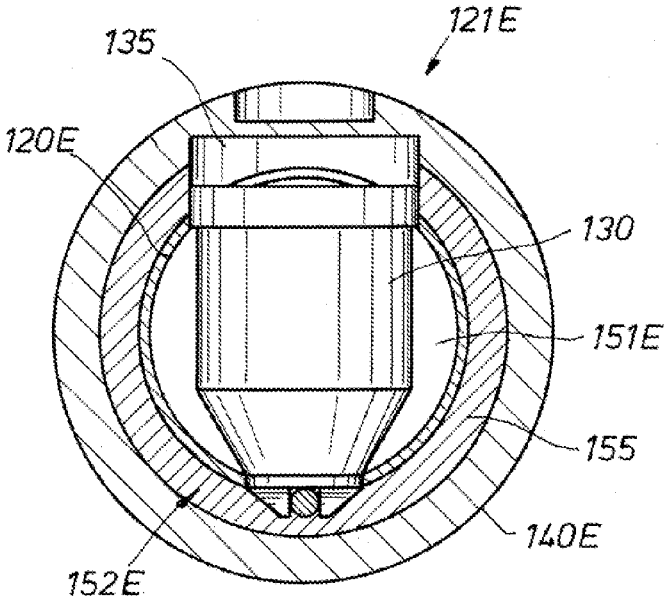
FIG. 8
FIG. 9
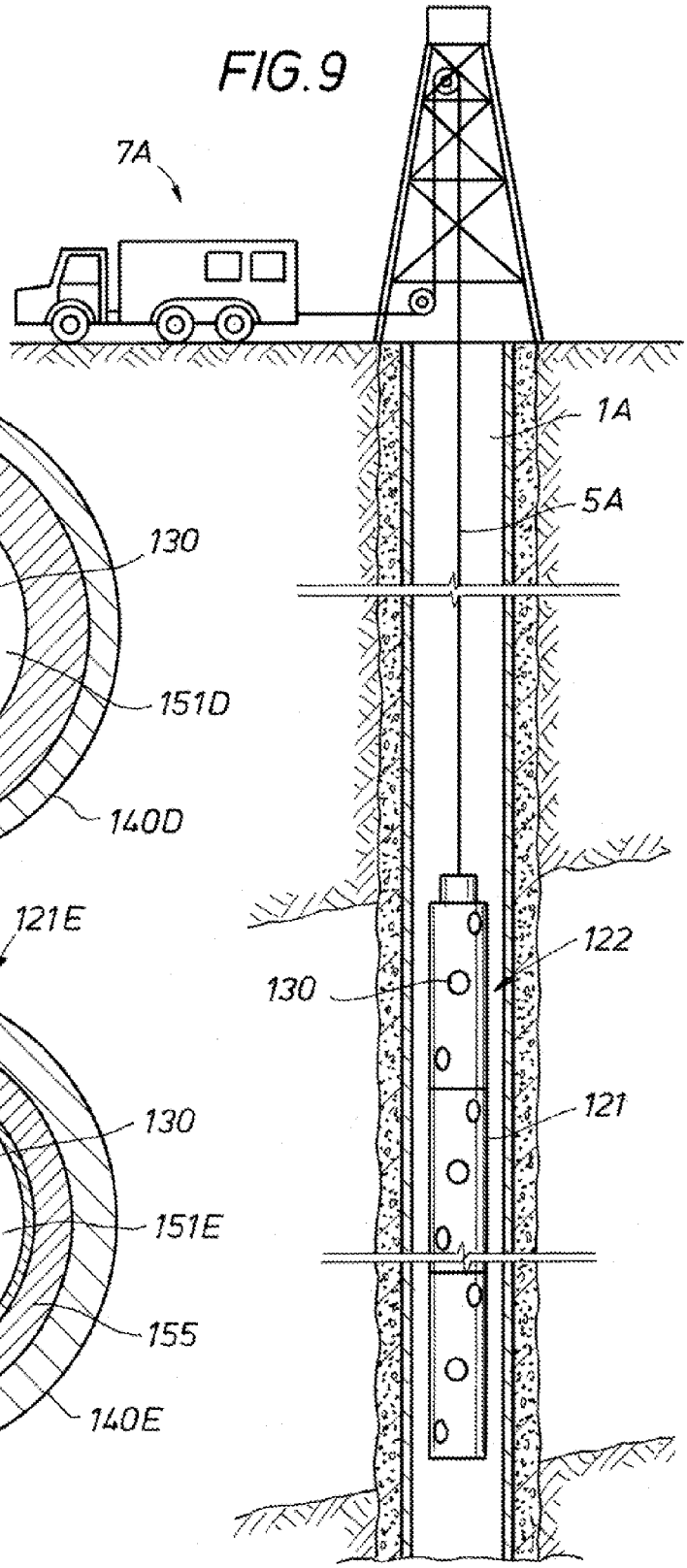

INTERNALLY SUPPORTED PERFORATING GUN BODY FOR HIGH PRESSURE OPERATIONS

CROSS REFERENCE TO RELATED APPLICATIONS

This application claims priority to and the benefit of co-pending U.S. Provisional Application Ser. No. 61/175,361, filed May 4, 2009, the full disclosure of which is hereby incorporated by reference herein.

BACKGROUND

1. Field of Invention

The invention relates generally to the field of oil and gas production. More specifically, the present invention relates to a perforating system provided with a substantially solid material between a gun body and tube and/or shaped charge.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

With reference to FIG. 2 to a side partial sectional view of a perforating gun 6 is shown. The perforating gun 6 an annular gun tube 16 in which the shaped charges 8 are arranged in a phased pattern. The gun tube 16 is coaxially disposed within an annular gun body 14. On an end of the perforating gun 6 is an end cap 20 shown threadingly attached to the gun body 14. On the end of the perforating gun 6 opposite the end cap 20 is a lower sub 22 also threadingly attached to the gun body 14. The lower sub 22 includes a chamber shown having an electrical cord 24 attached to a detonator 26. As is known, an associated firing head (not shown) can emit an electrical signal that transferred through the wire and to the detonator 26 for igniting a detonating cord 28 to then detonate the shaped charges 8.

The gun body 14 and gun tube 16 define an annulus 18 therebetween. The pressure in the annulus 18 is substantially at the atmospheric or ambient pressure where the perforating gun 6 is assembled—which is generally about 0 pounds per square inch gauge (psig). However, because shaped charge 8 detonation often takes place deep within a well bore, the static head pressure can often exceed 5,000 psig. As such, a large pressure difference can exist across the gun body 14 wall thereby requiring an enhanced strength walls as well as rigorous sealing requirements in a perforating gun 6.

SUMMARY OF INVENTION

Disclosed herein is a perforating system having a perforating gun enhanced to withstand high pressure wellbores. Embodiments include a solid gun system, a structural lattice, as well as a gun body filled with foam, fluid, sand, ceramic beads, eutectic metal, and combinations thereof.

BRIEF DESCRIPTION OF DRAWINGS

Some of the features and benefits of the present invention having been stated, others will become apparent as the description proceeds when taken in conjunction with the accompanying drawings, in which:

FIGS. 3-8 are axial partial sectional views of embodiments of a perforating gun in accordance with the present disclosure.

FIG. 3A is an axial sectional view of an alternative embodiment of the perforating gun of FIG. 3.

FIGS. 5A and 6A are side partial sectional views of the perforating guns of FIGS. 5 and 6 respectively.

FIG. 9 is a side partial sectional view of a perforating string in accordance with the present disclosure.

Figure 1:
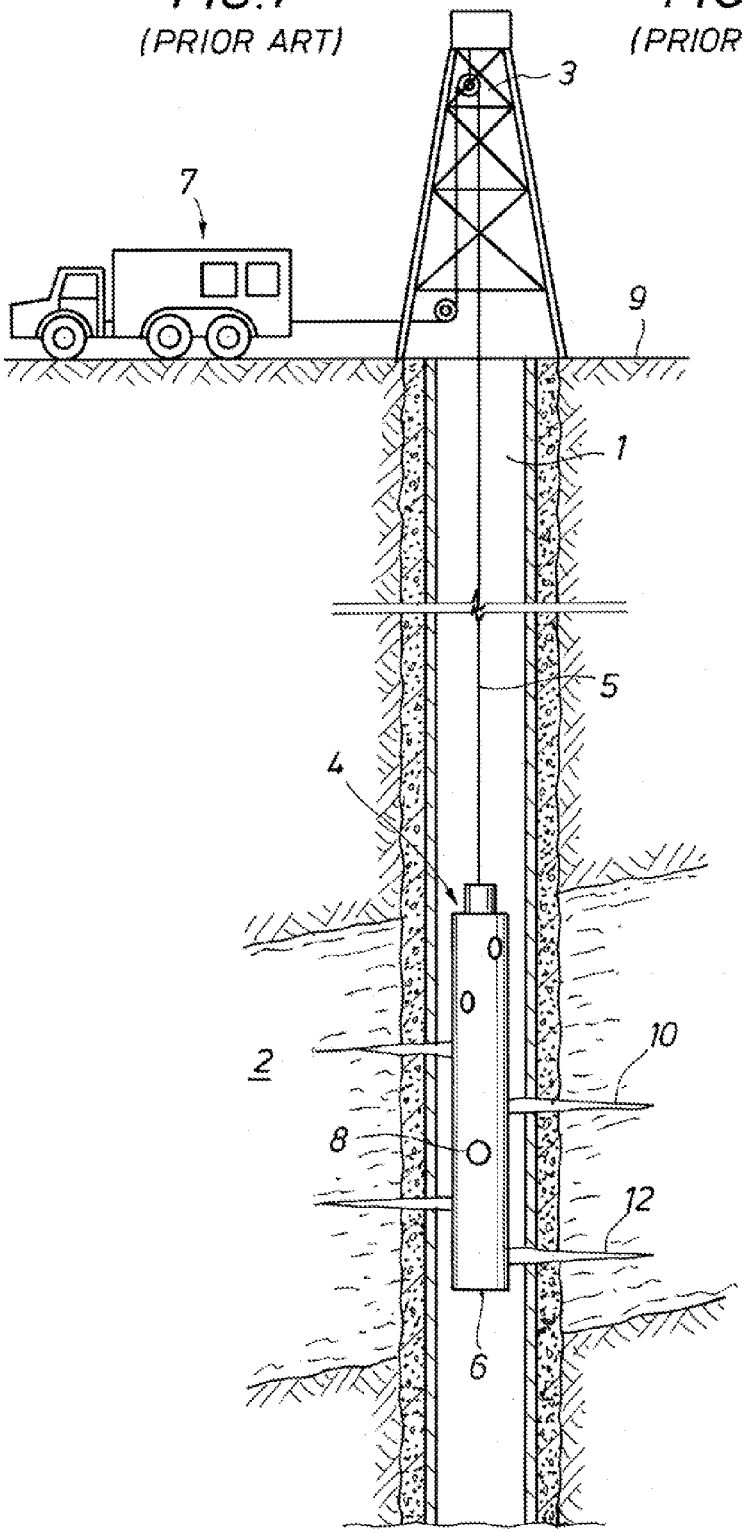
FIG.1 (PRIOR ART)
FIG. 1 is partial cutaway side view of a prior art perforating system in a wellbore.
Figure 2:
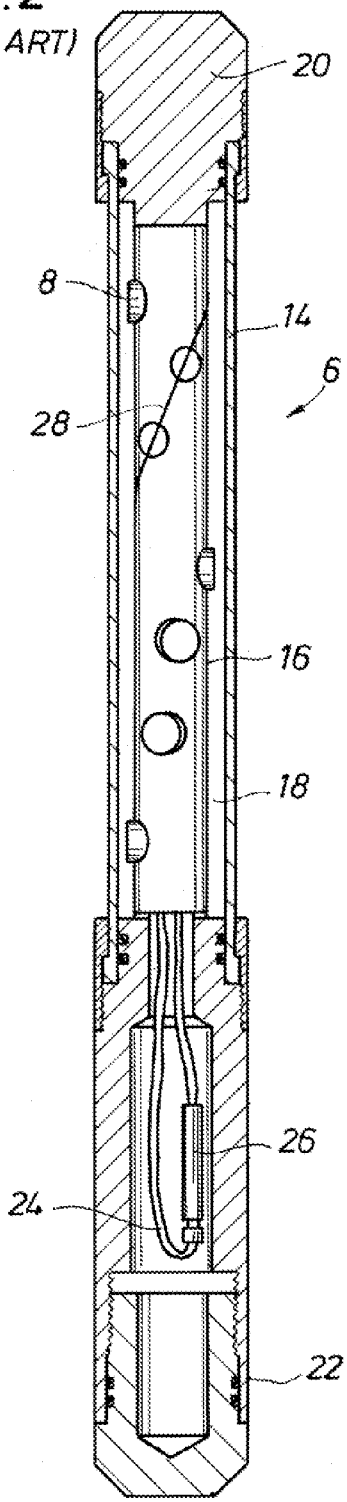
FIG.2 (PRIOR ART)
FIG. 2 is a side sectional view of a prior art perforating gun.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

With reference now to FIG. 3, an example of a perforating gun 121 is shown in an axial partial sectional view. In this embodiment, the perforating gun 121 includes a substantially solid gun body 140 circumscribing an annular gun tube 120. The gun body 140 is shown with an axial bore 141 having an inner diameter that is substantially the same as the outer diameter of the gun tube 120. In the embodiment of FIG. 3, the gun tube 120 occupies substantially the entire bore 141 when inserted into the gun body 140.

Held within the gun tube 120 is a shaped charge 130 having an annular cylindrical portion 131 concentric about an axis $A_x$ of the shaped charge 130. Shown on an end of the cylindrical portion 131 is a frusto-conical section 134 defined by outer side walls shown angling obliquely from the cylindrical portion 131 towards the axis $A_x$ and that end at a closed lower end. The shaped charge 130 is open on the end opposite the closed lower end. A high explosive (not shown) is provided through the upper end followed by insertion of a conical liner (not shown) over the explosive. FIG. 3 further depicts a detonation cord 133 and cord attachment 132 depending downward from the closed lower end of the shaped charge 130. A void 151 is defined between the shaped charge 130 and the gun tube 120. In the embodiment of FIG. 3, the thickness of the gun body 140 is greater than typical gun bodies. Therefore, the gun body 140 can withstand greater down hole pressures due to its increased thickness that in turn provides additional strength.

The gun body 140 is recessed above the opening of the shaped charge 130 and defines an open space 135 between the shaped charge 130 and an inner surface of the gun body 140. The open space 135, that may also be referred to as a set back, provides a space for formation of a jet (not shown) from a collapsing liner when the shaped charge 130 is detonated. Without the open space 135, the jet would be wider, less concentrated, and less developed when it contacts the gun body 140, thereby expending more energy when passing through the gun body 140 and having less energy for perorating a formation. Alternatively, the portion of the gun body 140 outside the opening of the shaped charge 130 may be an attachable member; such as a cap 137 as illustrated in the example embodiment of FIG. 3. The cap 137 can attach via threads 138, a weld, an interference fit, or other known means of attachment. An optional scallop 237 is shown formed on the outer surface of the cap 137. In an alternative example embodiment of a cap 137A, as illustrated in an axial sectional view in FIG. 3A, the scallop 237A is formed on an inner surface of the cap 137A so that the outer surface of the cap 137A has substantially the same curvature as the remaining circumference of the gun body 140.

An alternate embodiment of a high pressure perforating gun 121A is shown in an axial partial sectional view in FIG. 4. In this embodiment, a gun body 140A is provided that approximates a solid cylinder and has slots 142 radially formed within the gun body 140. The slots 142 are configured to receive a shaped charge 130 therein. An optional cap 137 is shown on a lateral side of the gun body 140, adjacent the slot 142, and aligned with the axis $A_x$. Threads 138 may be formed respectively on an outer circumference of the cap 137 and opening of the slot 142 adjacent the outer surface of the gun body 140A. The cap 137 can be removed thereby allowing access to the slot 142 for shaped charge 130 insertion. The dimensions of the cap 137 can be sized to a The thickness of the gun body 140A in FIG. 4 exceeds the thickness of known gun bodies, thereby providing strength to withstand high downhole pressures.

Referring now to FIG. 5, an axial partial sectional view is illustrated of an embodiment of a perforating gun 121B having an annular gun body 140B, a gun tube 120B inserted in the gun body 140B, and a shaped charge 130 secured within the gun tube 120B. In this embodiment the gun tube 120B and gun body 140B are sized such that an annular space 152 exists between the gun body 140B and gun tube 120B. In the annular space 152 a flowable material 137 is shown inserted. The flowable material 137 can be foam, fluid, sand, ceramic beads, eutectic metal, or combinations thereof. Moreover, the flowable material 137 may optionally be provided in the void 151 between the shaped charge 130 and the gun tube 120B. The flowable material 137 can be inserted axially into a perforating gun 121B prior to attaching the gun 121B to a gun string (not shown). Optionally, a port (not shown) can pass through a wall of the gun body 140B allowing flowable material 137 injection therethrough. FIG. 5A depicts the perforating gun 121B of FIG. 5 in a side partial sectional view. As shown in FIG. 5A, the flowable material 137 is provided between adjacent shaped charges 130 in the void 151 and space 152.

Illustrated in FIG. 6 is an axial partial sectional view of an example embodiment of a perforating gun 121C. In this embodiment, the perforating gun 121C includes an annular gun body 140C, a gun tube 120C in the gun body 140C, and a shaped charge 130 in the gun tube 120C. The example embodiment of FIG. 6 includes an annular space 152C between the gun body 140C and gun tube 120C and a void 151C between the gun tube 120C and the shaped charge 130. In the example of FIG. 6 a structured lattice 138 is illustrated in the annular space 152C and in the void 151C. The lattice 138 is formed to support the gun body 140C and resist forces resulting from pressure differentials experienced in a deep well or otherwise high pressure well. The lattice 138 shown includes multiple elongate planar members 139 intersectingly arranged to define interstices 143 between adjacent members 139, where the interstices 143 are elongate and run substantially parallel with an axis $A_B$ of the gun body 140C. The members 139 of FIG. 6 are arranged in sets of parallel planes, where one of the sets is substantially perpendicular to the other set to configure the interstices 143 with four sides and a square or diamond shaped outer periphery. Alternate embodiments include interstices 143 with outer peripheries having more or less than, four sides and peripheries having other shapes, such as hexagonal (honeycomb), curved, and the like. Strategically arranging the members 139 forms the lattice 138 that provides structural support so the gun body 140C can withstand applied high pressures. The lattice 138 for use with the device disclosed herein is not limited to the arrangement of FIG. 6, but can include any set of structural elements arranged to support the gun body 140C. An additional examples of another lattice or truss like arrangements that may be employed includes one or more tubulars concentric to the gun body 140C having elongated members radially attached between the tubulars and the gun body 140C. Alternatively, the interstices 143 may project radially within the void 151C and/or annular space 152C.

The perforating gun 121C of FIG. 6 is shown in a side partial sectional view in FIG. 6A. In the embodiment of FIG. 6A, the lattice 138 can extend fully between adjacent shaped charges 130 in the void 151 and space 152. Optionally, the lattice 138 may formed into segments that occupy a portion of the void 151 and/or space 152 between adjacent shaped charges 130. Embodiments exist where an entire perforating gun 121C includes a continuous span of lattice 138 in one or both of the void 151 and space 152, with portions removed to accommodate the shaped charges 130. Alternatively, the entire perforating gun 121C may have only segmented lattice 138 extends a portion between adjacent shaped charges 130.

FIG. 7 provides a side sectional view of an example embodiment of a perforating gun 121 D shown in a side sectional view. In the example of FIG. 7, the perforating gun 121 D includes a gun body 140D and an enlarged gun tube 120D whose outer diameter is projected radially outward into contact with the inner diameter of the gun body 140D. The embodiment of the gun body 140D of FIG. 7 can have the same dimensions as the gun bodies 140, 140A, 140B, 140C of FIGS. 3-6, or can have dimensions with one or both of an inner or outer diameter respectively greater or less than the other gun bodies. Referring now to FIG. 8, an example embodiment of a perforating gun 121E is illustrated in a side partial sectional view. The perforating gun 121E includes an annular gun body 140E, an annular gun tube 120E coaxially inserted within the gun body 140E, and a shaped charge in the gun tube 120E. A void 151E is defined between the outer surface of the shaped charge 130 and inner diameter of the gun tube 120E. An annular space 152E forms between the gun body 140E and gun tube 120E, an inner liner 155 is shown provided in the annular space 152E. The inner liner 155 can be made of a steel or steel alloy, the same material as the gun body and/or gun tube, a polymer, a composite, and combinations thereof.

An example of a high pressure wellbore or borehole include a wellbore having a pressure of at least about 15,000 pounds per square inch, at least about 20,000 pounds per square inch, at least about 25,000 pounds per square inch, at least about 30,000 pounds per square inch, at least about 35,000 pounds per square inch, at least about 40,000 pounds per square inch, at least about 45,000 pounds per square inch, and at least about 50,000 pounds per square inch. The pressures listed above can occur at any location or locations in the wellbore. In operation, the perforating guns 121 depicted in FIGS. 3-8 may be lowered into a high pressure wellbore and withstand the pressure therein without experiencing a damaging effect, such as the gun body buckling or rupturing. The shaped charge 130 in the perforating gun 121 can then be detonated to perforate within the wellbore. In an embodiment, multiple shaped charges 130 can be included within a perforating gun 121. Optionally, a perforating string having multiple perforating guns 121 as described herein can be formed, deployed within a high pressure wellbore, and the shaped charges within detonated.

Each of the embodiments of FIGS. 3-8 include an open space 135 formed in the gun body 121 above the shaped charge 130 opening. Alternate embodiments exist where the gun body extends into substantial contact with the open end of the shaped charge 130. Removing this material away from the shaped charge 130 opening can prevent hindering the formation of or the ejecting of a metal jet from the shaped charge 130. Example materials of the gun body 140 include steel, steel alloys, propellant, a reactive material, fibers, a fiber reinforced material, composites, ceramic, any machine cast or molded material, and combinations thereof.

FIG. 9 illustrates an example of a perforating system that includes a perforating string 122 deployed in a wellbore 1A on a wireline 5A. Tubing, slickline, and other deployment means, may be used as alternatives for the wireline 5A. In the embodiment of FIG. 9, a surface truck 7A is provided at the surface for control and/or operation of the perforating string 122. The perforating string 122 of FIG. 9 includes a series of perforating guns 120 connected end to end. Embodiments exist where the perforating guns 120 include the variations described above and in FIGS. 3-8, 5A, and 6A. Accordingly, the wellbore 1A can be a high pressure wellbore as above described. Shaped charges 130 provided in the perforating guns 120 may be detonated within the wellbore 1A to create perforations (not shown).

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A perforating system comprising;

an annular gun body having an axial bore, an inner diameter, and an outer diameter;

a gun tube having an outer diameter substantially the same as the inner diameter of the gun body and inserted in the axial bore of the gun body;

a shaped charge having an open end set in an opening formed through a sidewall of the gun tube;

a bore formed in a sidewall of the gun tube through which the open end of the shaped charge extends; and an open space formed in the inner diameter of the gun body that registers with the open end of the shaped charge and has a diameter substantially the same as a diameter of the open end.

2. The perforating system of claim 1, wherein the annular gun body maintains an annular configuration when disposed in a wellbore at a pressure of at least about 30,000 pounds per square inch.

3. The perforating system of claim 1, wherein the portion of the gun body adjacent the open space comprises a cap.

4. The perforating system of claim 3, wherein the cap is selectively removable from the gun body.

5. The perforating system of claim 1, wherein the inner diameter of the gun body is set back from the open end of the shaped charge, so that when the shaped charge is detonated a jet is produced that is substantially formed when it contacts the gun body.

6. A perforating gun comprising:

an annular gun body;

an annular gun tube inserted within the gun body;

an annular space between the gun tube and the gun body;

a shaped charge set in a bore formed through a sidewall of the gun tube;

a void between the gun tube and the shaped charge; and a lattice of planar structural members disposed between the shaped charge and the gun body having interstices defined between adjacent structural members.

7. The perforating gun of claim 6, wherein the interstices defined between the structural members are substantially parallel with an axis of the gun body.

8. The perforating gun of claim 6, wherein the lattice is in a location selected from the group consisting of the void, the annular space, and the void and the annular space.

9. A perforating system comprising;

a shaped charge having an open end, a closed end, and an axis intersecting the open end and closed end;

an annular gun body and an axial bore therethrough; and an annular gun tube inserted into the gun body and having an axis substantially perpendicular to the axis of the shaped charge, an inner diameter, bores in the oppositely facing sidewalls for receiving the open end and closed end of the shaped charge, an outer diameter that extends radially outward into contact with an outer surface of the axial bore, and a wall thickness greater than the wall thickness of the gun body, so that when the perforating system is disposed in a wellbore having a pressure exceeding a wall strength of the gun body, the thicker gun tube provides support to retain the shape of the gun body.

10. The perforating system of claim 9, wherein the annular gun body maintains an annular configuration when disposed in a wellbore at a pressure of at least about 30,000 pounds per square inch.

11. The perforating system of claim 9, further comprising an open space formed through the gun tube adjacent the open end of the shaped charge, wherein at least a portion of the open space is between the open end of the shaped charge and an outer circumference of the gun tube.

12. The perforating system of claim 9, further comprising a detachable cap selectively removable from the gun body adjacent the open end of the shaped charge.

13. The perforating system of claim 11, wherein the open space extends radially outward into the gun body to define a void extending from the open end to radially past an inner circumference of the gun body.

* * * * *